US008206094B2

(12) United States Patent
Seki et al.

(10) Patent No.: US 8,206,094 B2
(45) Date of Patent: Jun. 26, 2012

(54) STATIONARY BLADE RING OF AXIAL COMPRESSOR

(75) Inventors: Naoyuki Seki, Takasago (JP); Taku Ichiryu, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 464 days.

(21) Appl. No.: 11/589,732

(22) Filed: Oct. 31, 2006

(65) Prior Publication Data

US 2007/0177973 A1 Aug. 2, 2007

(30) Foreign Application Priority Data

Jan. 27, 2006 (JP) ..... 2006-018995

(51) Int. Cl.
*F01D 25/28* (2006.01)
*F01D 1/02* (2006.01)

(52) U.S. Cl. ..... 415/191; 415/209.4; 415/210.1

(58) Field of Classification Search ..... 415/191, 415/209.4, 210.1, 211.1
See application file for complete search history.

(56) References Cited

U.S. PATENT DOCUMENTS 3,326,523 A 6/1967 Bobo
4,395,195 A * 7/1983 De Cosmo et al. ..... 415/137
4,897,021 A * 1/1990 Chaplin et al. ..... 415/173.7
5,022,818 A * 6/1991 Scalzo ..... 415/209.3
5,141,395 A 8/1992 Carroll et al.
5,346,362 A 9/1994 Bonner et al.
5,421,703 A * 6/1995 Payling ..... 415/209.4
5,593,276 A 1/1997 Proctor et al.
5,846,050 A * 12/1998 Schilling ..... 415/135
6,042,334 A * 3/2000 Schilling ..... 415/173.7
6,139,264 A * 10/2000 Schilling ..... 415/174.2
6,296,443 B1 * 10/2001 Newman et al. ..... 415/209.2
6,592,326 B2 * 7/2003 Marx et al. ..... 415/208.2
6,595,747 B2 7/2003 Bos
6,969,239 B2 * 11/2005 Grant et al. ..... 416/220 R
2003/0082051 A1 5/2003 Bertrand et al.

(Continued)

FOREIGN PATENT DOCUMENTS

EP 0 353 498 2/1990

(Continued)

OTHER PUBLICATIONS

Korean Office Action dated Aug. 28, 2007, Application No. 10-2006-0106355.

(Continued)

*Primary Examiner* — Edward Look
*Assistant Examiner* — Sean J Younger
(74) *Attorney, Agent, or Firm* — Westerman, Hattori, Daniels & Adrian, LLP

(57) ABSTRACT

An inner shroud portion and an outer shroud portion dividedly formed per stationary blade are formed integrally with each stationary blade. A plurality of the stationary blades adjacent to each other in a circumferential direction are coupled together by a band member at the outer shroud portions. The inner shroud portions are held between seal holders which are formed as two divided members in the flowing direction of a working fluid, which are fastened by a bolt, and which have a length corresponding to the plurality of the stationary blades. The plurality of stationary blades, the inner and outer shroud portions, the band member, and the seal holders assembled in this manner constitute a unit. A plurality of the units are connected in the circumferential direction to constitute a stationary blade ring of an axial compressor.

8 Claims, 7 Drawing Sheets

U.S. PATENT DOCUMENTS

2004/0062652 A1 4/2004 Grant et al.

FOREIGN PATENT DOCUMENTS

| | | | |
|---|---|---|---|
| EP | 0 384 166 | | 8/1990 |
| FR | 1.252.179 | | 1/1961 |
| JP | 1-159499 | A | 6/1989 |
| JP | 2-070929 | A | 3/1990 |
| JP | 2-245403 | A | 10/1990 |
| JP | 10-054207 | A | 2/1998 |
| JP | 10-317910 | A | 12/1998 |
| JP | 2002-242611 | A | 8/2002 |

OTHER PUBLICATIONS

European Search Report dated Oct. 5, 2007, Application No. 06121887.1-2315.

Japanese Office Action dated Apr. 19, 2011, issued in corresponding Japanese Patent Application No. 2006-018995.

* cited by examiner (Section along line A-A)

(Viewed along line B-B)

STATIONARY BLADE RING OF AXIAL COMPRESSOR

BACKGROUND OF THE INVENTION

1. Field of the Invention

This invention relates to a stationary blade ring of an axial compressor, such as a gas turbine compressor, the stationary blade ring being designed to improve reliability and performance of a compressor by achieving built-up stationary blades.

2. Description of the Related Art

FIGS. 7(*a*) and 7(*b*) are explanation drawings of a compressor stationary blade ring of a conventional gas turbine, FIG. 7(*a*) being a sectional view, and FIG. 7(*b*) a view taken in the direction of an arrow C in FIG. 7(*a*). In the drawings, the numeral 100 denotes a stationary blade of a compressor, and the numeral 101 denotes an outer shroud for the stationary blade. The outer shroud 101 is built into a compressor casing 102. The numeral 103 denotes an inner shroud. The stationary blade 100 is fixed by fillet welding to the outer shroud 101 and the inner shroud 103 at tenon portions (protrusions) 100*a* and 100*b*, respectively. The numerals 104*a*, 104*b* are seal arms for the inner shroud 103 which oppose the seal surface of a rotor 105 for preventing leakage of compressed air (see Japanese Unexamined Patent Publication No. 1998-317910).

In the above-described structure, the stationary blade 100 is fixed by welding to the inner shroud 103 and the outer shroud 101. A plurality of the stationary blades 100 are arranged circumferentially to constitute a stationary blade ring which is divided into two parts on the entire circumference. A plurality of such stationary blade rings are mounted in the axial direction, and moving blades are rotated between these stationary blade rings to form gas turbine operating air.

With the above-described stationary blade ring as the earlier technology, however, the stationary blade 100 and the inner and outer shrouds 103, 101 are bound together at the tenon portions 100*a*, 100*b*. In welding, a notch defect may occur in the bottom of a welded overlay. This tendency is strong with fillet welding of this example, where there is a possibility for the occurrence of cracking starting in the fillet weld zones. The seal arms 104*a*, 104*b* are also bound to the inner shroud 103 by fillet welding, thus posing the same possibility. Under these circumstances, a further improvement in the life of the compressor stationary blade has been demanded.

Furthermore, the stationary blade 100 and the inner and outer shrouds 103, 101 are fixed to each other by fillet welding, and they are constructed metallurgically integrally. This has caused the disadvantage that a damping effect is low in response to vibrations of the blade. If the blade is thinned, there will be overstress, presenting an impediment to an improvement in the performance of the compressor ascribed to the thin-walled blade.

The present invention has been accomplished in light of the above-described problems with the earlier technology. It is an object of the invention to provide a stationary blade ring of a compressor, the stationary blade ring being composed of built-up stationary blades, which remove the notch at the junction between the shroud and the blade, and improve damping responsive to vibrations to render it possible to thin an airfoil, thereby achieving improvements in the reliability and performance of an axial compressor including a gas turbine compressor.

SUMMARY OF THE INVENTION

A first aspect of the present invention is a stationary blade ring of an axial compressor, comprising a plurality of units connected together in a circumferential direction, each unit comprising: a plurality of stationary blades adjacent to each other in the circumferential direction; an inner shroud portion and an outer shroud portion dividedly formed per stationary blade, and formed integrally with each stationary blade; and a band member for coupling together the plurality of stationary blades at the outer shroud portions.

A second aspect of the present invention is the stationary blade ring of an axial compressor according to the first aspect, where in the band member is directly slidably fitted into a guide groove portion on a side of a compressor casing.

A third aspect of the present invention is the stationary blade ring of an axial compressor according to the second aspect, wherein the outer shroud portions for the plurality of stationary blades are coupled together by an auxiliary band member different from the band member.

A fourth aspect of the present invention is the stationary blade ring of an axial compressor according to the first aspect, wherein the outer shroud portions coupled by the band member are directly slidably fitted into a guide groove portion on a side of a compressor casing.

A fifth aspect of the present invention is the stationary blade ring of an axial compressor according to the first aspect, wherein the inner shroud portions are held by a seal holder having a length corresponding to the plurality of stationary blades adjacent to each other in the circumferential direction.

A sixth aspect of the present invention is the stationary blade ring of an axial compressor according to the fifth aspect, wherein the seal holder is divided into two portions in a flowing direction of a working fluid, and the two portions are fastened together by a fastening means.

A seventh aspect of the present invention is a stationary blade ring of an axial compressor, comprising a plurality of units connected together in a circumferential direction, each unit comprising: a plurality of stationary blades adjacent to each other in the circumferential direction; an inner shroud portion and an outer shroud portion dividedly formed per stationary blade, and formed integrally with each stationary blade; connecting means for coupling together the plurality of stationary blades at the outer shroud portions; and a seal holder for holding the inner shroud portions, the seal holder having a length corresponding to the plurality of stationary blades.

An eighth aspect of the present invention is the stationary blade ring of an axial compressor according to the seventh aspect, wherein the seal holder is divided into two portions in a flowing direction of a working fluid, and the two portions are fastened together by a fastening means.

A ninth aspect of the present invention is the stationary blade ring of an axial compressor according to the seventh aspect, wherein the inner shroud portion and the seal holder are bound together by a pin.

A tenth aspect of the present invention is the stationary blade ring of an axial compressor according to the seventh aspect, wherein a spacer is interposed between the inner shroud portions adjacent to each other in the circumferential direction, and a spacer is interposed between the outer shroud portions adjacent to each other in the circumferential direction.

According to the compressor stationary blade ring of the gas turbine of the present invention, the built-up stationary blades can be achieved, and fillet welding can be abolished. This eliminates the possibility for cracking, and enhances the reliability of the compressor. Moreover, repair for cracking, if any, becomes unnecessary, so that the interval between periodical inspections can be lengthened. Furthermore, blade vibrations can be damped, and the reduction of stress enables the blade to be thinned. Thus, the performance of the compressor can be improved.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

A stationary blade ring of an axial compressor according to the present invention will now be described in detail by embodiments with reference to the accompanying drawings.

Embodiment 1

Figure 1:
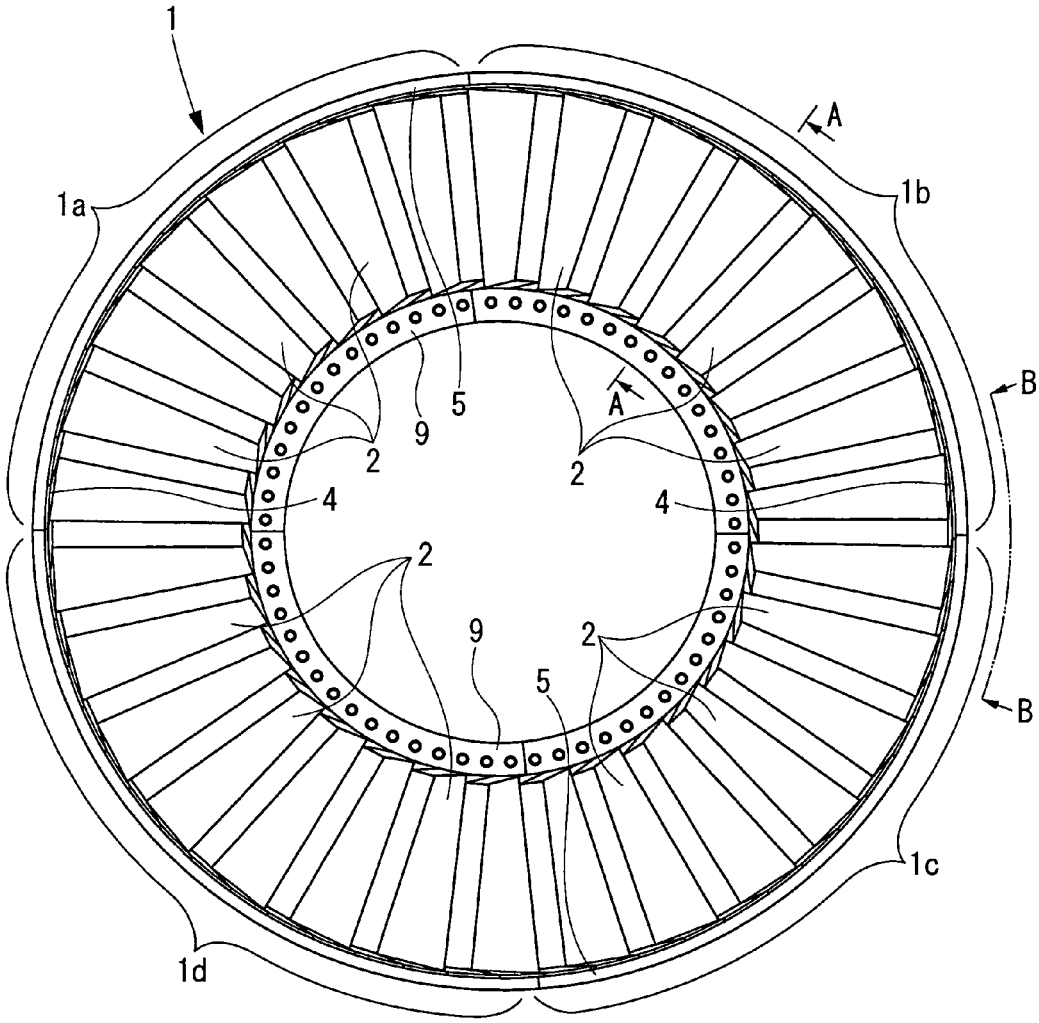
FIG. 1 is a front view of a compressor stationary blade ring of a gas turbine, showing Embodiment 1 of the present invention.
Figure 2:
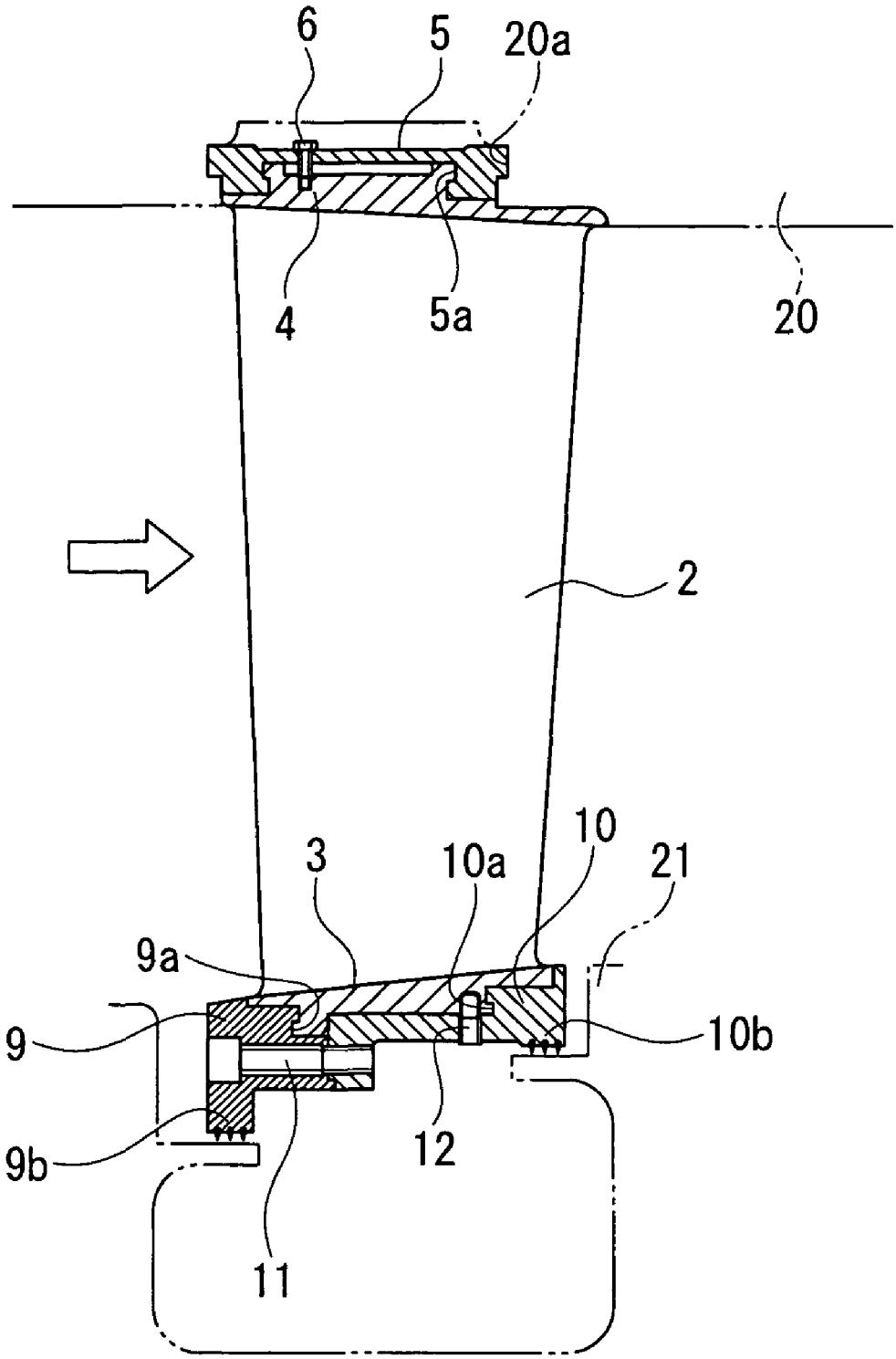
FIG. 2 is a sectional view taken on line A-A in FIG. 1.
Figure 3:
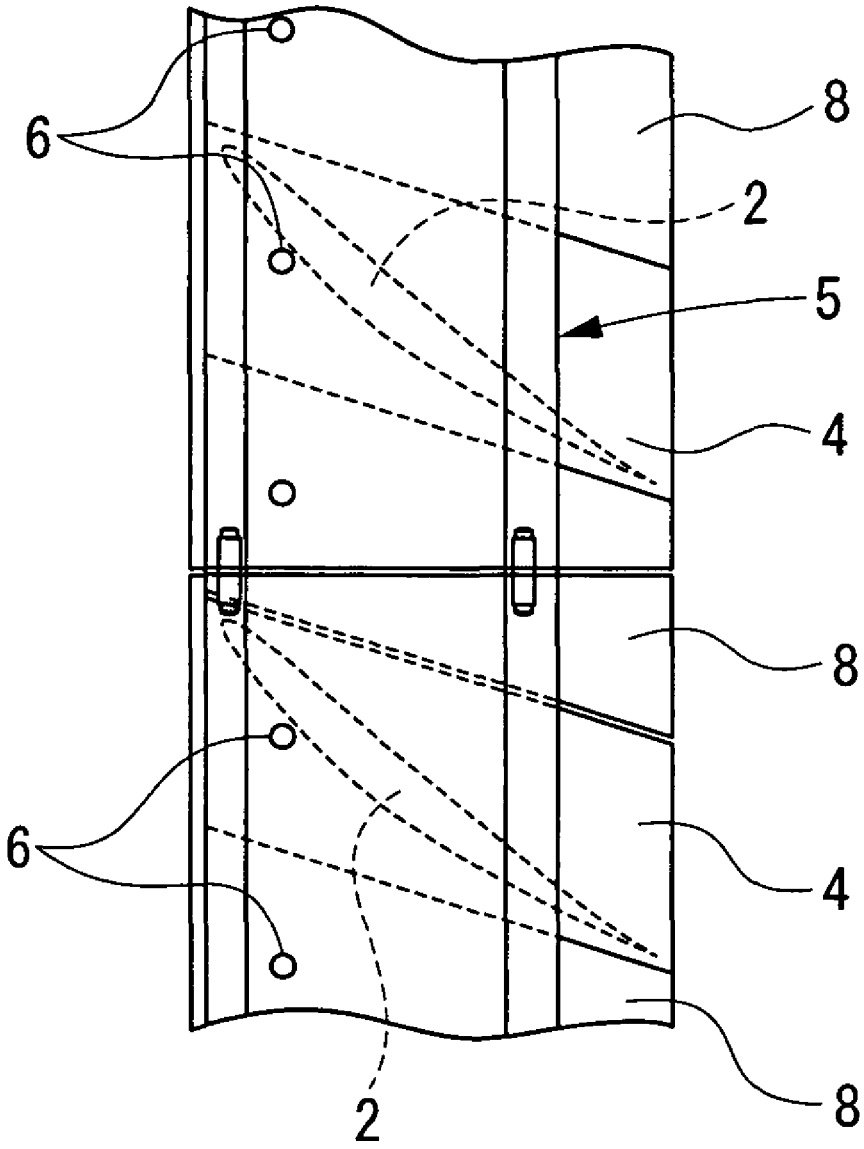
FIG. 3 is a view taken along line B-B in FIG. 1.

FIG. 1 is a front view of a compressor stationary blade ring of a gas turbine, showing Embodiment 1 of the present invention. FIG. 2 is a sectional view taken on line A-A in FIG. 1. FIG. 3 is a view taken along line B-B in FIG. 1.

As shown in FIG. 1, a compressor stationary blade ring 1 of a gas turbine according to the present embodiment is divided into first to fourth units, 1*a* to 1*d*, in the circumferential direction. The first unit 1*a* is equipped with seven stationary blades 2, the second unit 1*b* is equipped with eight stationary blades 2, the third unit 1*c* is equipped with seven stationary blades 2, and the fourth unit 1*d* is equipped with eight stationary blades 2. The first unit 1*a* and the second unit 1*b* are built into an upper half of a compressor casing 20 (see FIG. 2), while the third unit 1*c* and the fourth unit 1*d* are built into a lower half of the compressor casing 20.

The structures of the first unit 1*a* to the fourth unit 1*d* will be described with reference to FIGS. 2 and 3. First, the stationary blade 2 and an inner shroud portion 3 and an outer shroud portion 4, which are formed dividedly per stationary blade, are integrally constructed.

A predetermined number, for the corresponding unit, of the outer shroud portions 4 are coupled together by a band member (may be referred to as an outer holder: coupling means) 5, and are slidably fitted into a guide groove portion 20*a* of the compressor casing 20 at front and rear portions (an upstream portion and a downstream portion in the direction of flow of a working fluid (see an open arrow in FIG. 2)) via the band member 5. The band member 5 has a length which corresponds to nearly a quarter of the circumference of the compressor stationary blade ring 1. The band member 5 is slidably fitted to each outer shroud portion 4 at front and rear portions via a guide groove portion 5*a*, and is then bound to the outer shroud portion 4 by a bolt 6.

In FIG. 3, the numeral 8 denotes a spacer interposed between the outer shroud portions 4 adjacent to each other in the circumferential direction and, if the manufacturing cost allows leeway, the spacer may be formed integrally with the outer shroud portion 4, without being provided as a separate spacer.

A predetermined number, for the corresponding unit, of the inner shroud portions 3 are held by seal holders 9, 10 at front and rear portions of the inner shroud portion 3 in such a manner as to be slidably fitted into guide groove portions 9*a*, 10*a* of the seal holders 9, 10, the seal holders 9, 10 being provided as two divided members in the flowing direction of the working fluid or in the axial direction of the rotor and being fastened together by a bolt (fastening means) 11. In the present embodiment, the seal holders 9, 10 are formed as two divided members in order to facilitate an assembly operation, but they may be formed as an integral type or a trisected type in consideration of the manufacturing cost or the strength of the structure.

The seal holders 9, 10 each have a length which corresponds to nearly a quarter of the circumference of the compressor stationary blade ring 1. The seal holders 9, 10 are bound to each inner shroud portion 3 by a pin 12, and have inner peripheral seal portions 9*b*, 10*b* in airtight sliding contact with an outer peripheral portion of a rotor 21. As in the case of the outer shroud portion 4, spacers (not shown) are each interposed between the inner shroud portions 3 adjacent to each other in the circumferential direction. If the manufacturing cost allows leeway, this spacer may be formed integrally with the inner shroud portion 3, without being provided as a separate spacer.

In the present embodiment, as described above, the compressor stationary blade ring 1 is divided into the first to fourth units 1*a* to 1*d* in the circumferential direction, and the stationary blade 2 in each of the units 1*a* to 1*d* and the inner and outer shroud portions 3, 4 dividedly formed per stationary blade are integrally formed from a predetermined material by a predetermined processing method.

By so doing, conventional fillet welding can be abolished. This eliminates the possibility for cracking, and improved durability (fatigue strength) enhances the reliability of the compressor. Moreover, repair for cracking which has occurred becomes unnecessary, and can thus lengthen the interval between periodical inspections.

Furthermore, a predetermined number, for the corresponding unit, of the outer shroud portions 4 can be coupled together by the band member 5, and thus their assembly and disassembly are easy.

During the operation of the gas turbine, the vibrating force of the working fluid generates vibrations of the blades. In the present embodiment, however, the inner and outer shroud portions 3, 4 are dividedly formed per stationary blade. Thus, the sites of contact between the inner and outer shroud portions 3, 4 and the spacers 8 (the inner shroud portions 3, 3 and the outer shroud portions 4, 4 in the absence of the spacers 8) adjacent to each other in the circumferential direction slide under the vibrating force of the working fluid, thereby producing a frictional damping effect. Thus, vibrations of the blades can be kept at a low level. That is, the effect of decreasing stress can thin the blades to achieve an improvement in the performance of the compressor.

The inner shroud portion 3, in particular, is held between the seal holders 9 and 10, which are provided as two divided members and fastened by the bolt 11, whereby a built-up structure is constructed. Unlike a welded structure, the built-up structure enhances fatigue strength, and permits slide between the inner shroud portion 3 and the seal holders 9, 10, producing a frictional damping effect. Thus, vibrations of the blades can be further kept down.

Besides, the inner shroud portion 3 and the seal holder 10 are bound together by the pin 12. This avoids the occurrence of fretting wear and cracking due to fine vibrations of the inner shroud portion 3 (in other words, the stationary blade 2). In place of the pin 12, a binding means which gives a damping effect can be applied, such as a bolt or a combination of a bolt and a spring.

Embodiment 2

Figure 4:
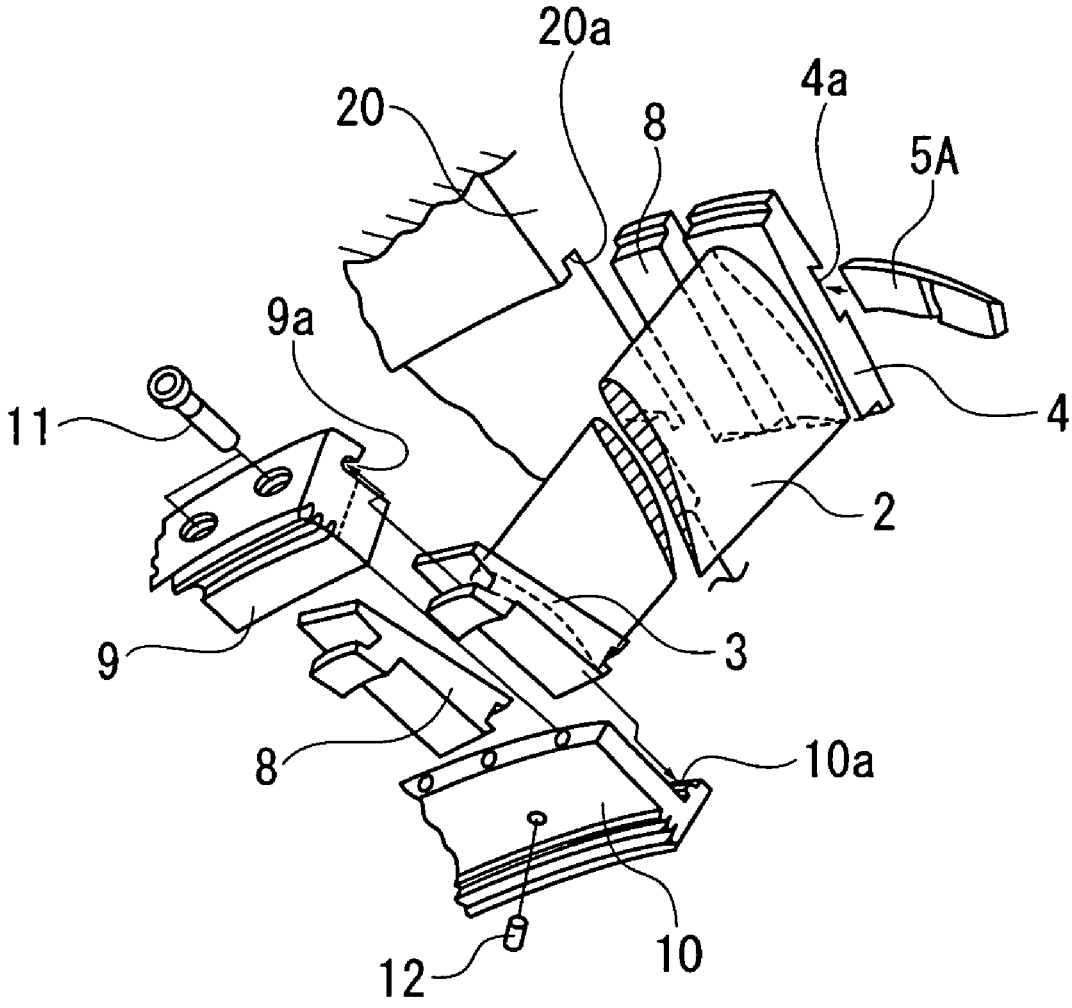
FIG. 4 is an exploded perspective view of essential parts of the compressor stationary blade ring of the gas turbine, showing Embodiment 2 of the present invention.
Figure 5:
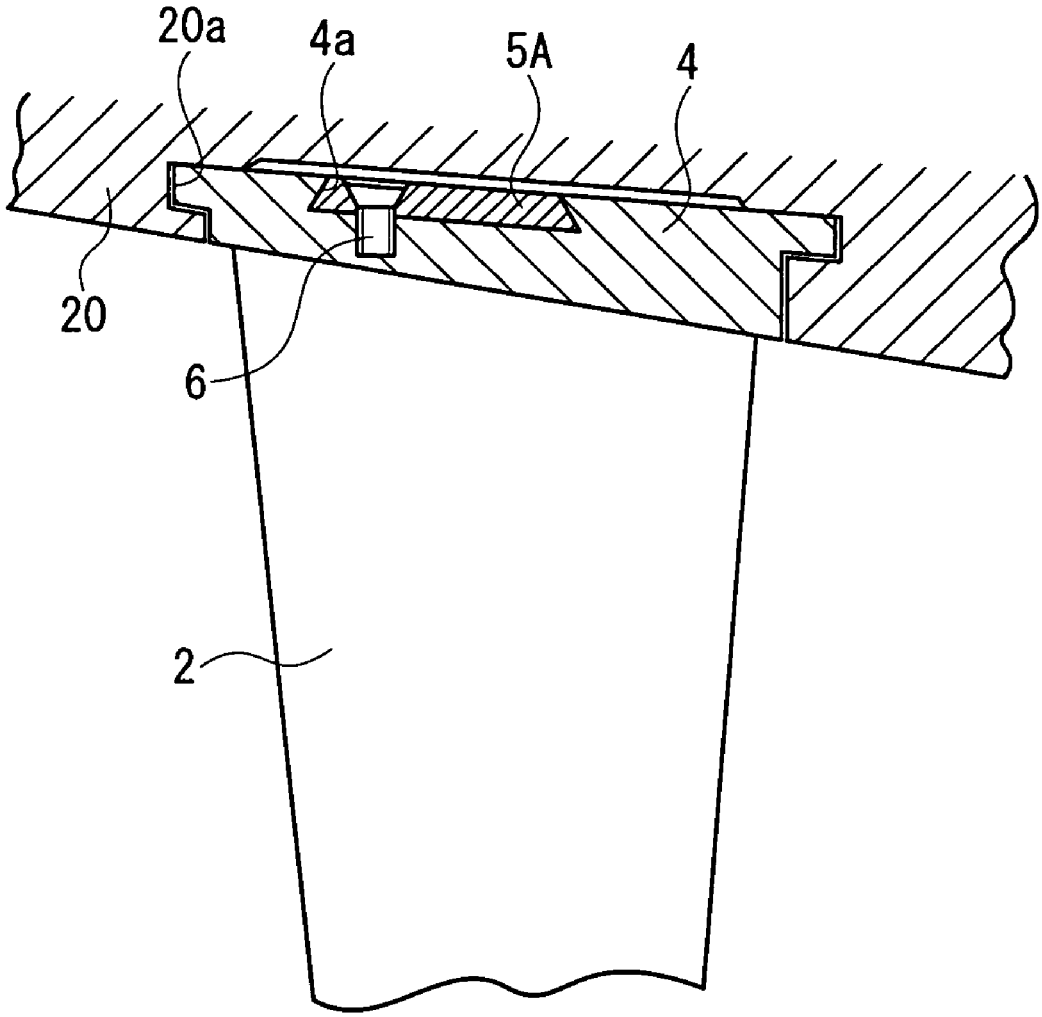
FIG. 5 is an enlarged sectional view of the essential parts in FIG. 4.

FIG. 4 is an exploded perspective view of essential parts of the compressor stationary blade ring of the gas turbine, showing Embodiment 2 of the present invention. FIG. 5 is an enlarged sectional view of the essential parts in FIG. 4.

This is an embodiment in which the outer shroud portion 4 and the spacer 8 in Embodiment 1 are coupled together by a narrow band member 5A (coupling means) fitted into dovetail grooves 4*a* (the dovetail groove of the spacer 8 is not shown) formed in upper surface regions (on the outer peripheral side) of the outer shroud portion 4 and the spacer 8, and the outer shroud portion 4 and the spacer 8 are directly slidably fitted into the guide groove portion 20*a* of the compressor casing 20. Other features are the same as those in Embodiment 1.

According to this embodiment, the advantage is obtained that the band member 5A can be formed compactly, in addition to the same actions and effects as those in Embodiment 1. In the present embodiment as well, the use of the spacer 8 is not compulsory.

Embodiment 3

Figure 6:
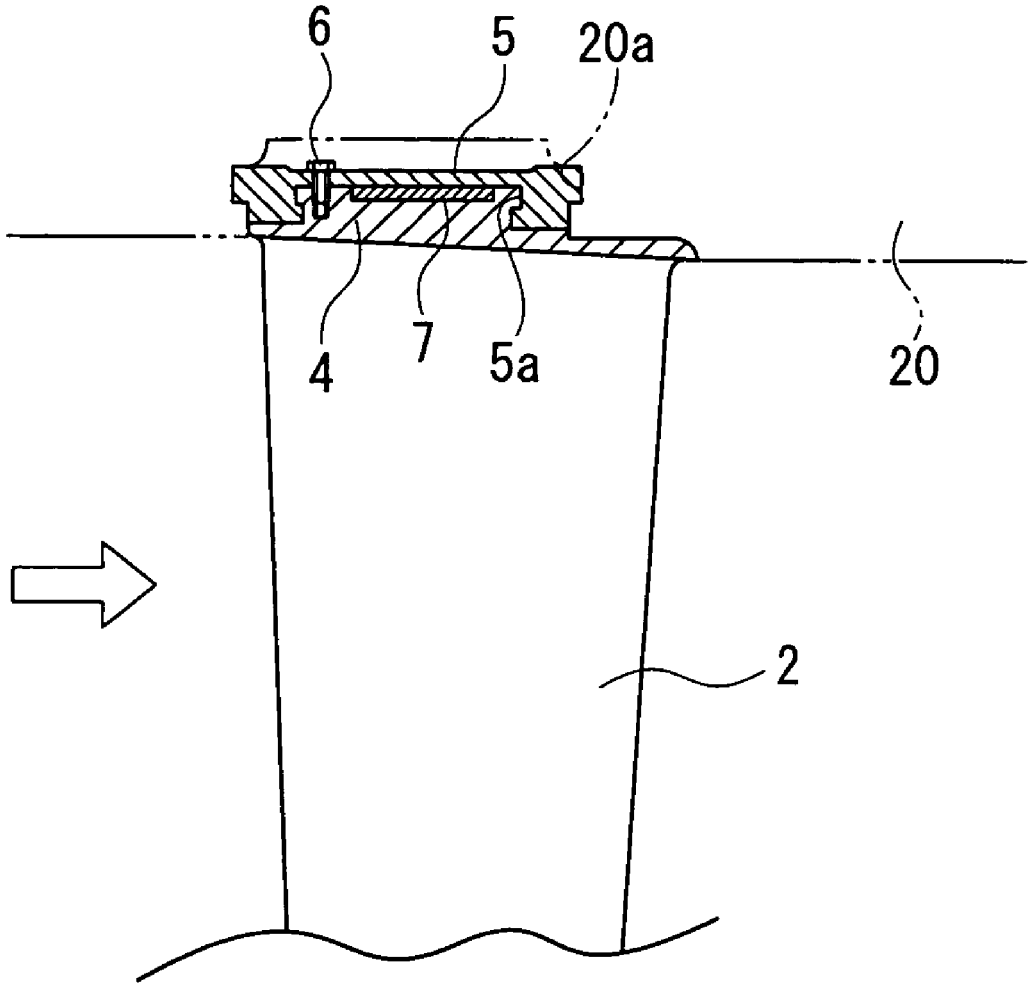
FIG. 6 is a sectional view of the essential parts of the compressor stationary blade ring of the gas turbine, showing Embodiment 3 of the present invention.
Figure 7:
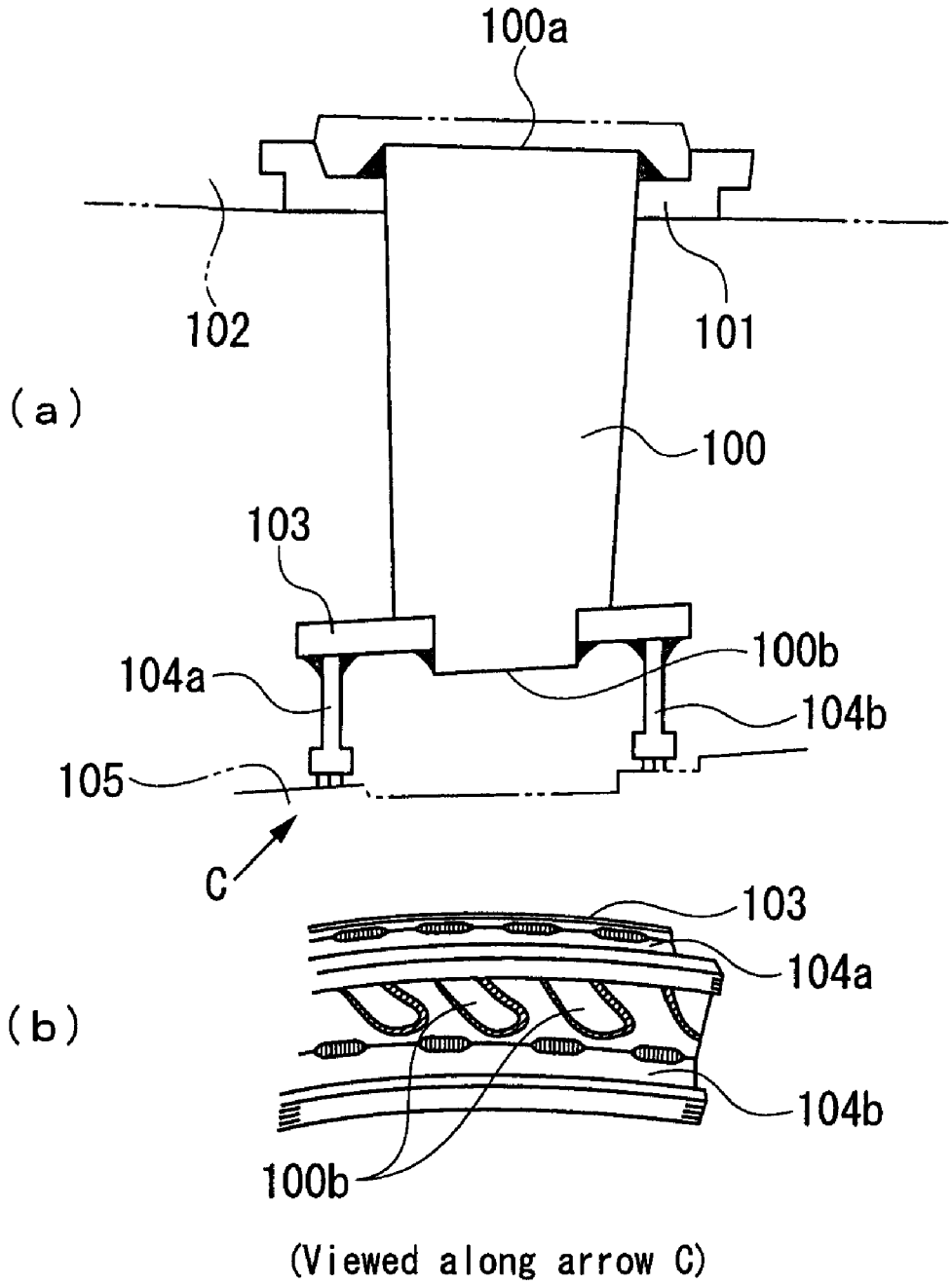
Fig.7 Related Art
FIGS. 7(*a*) and 7(*b*) are explanation drawings of a compressor stationary blade ring of a conventional gas turbine, FIG. 7(*a*) being a sectional view, and FIG. 7(*b*) a view taken in the direction of an arrow C in FIG. 7(*a*).

FIG. 6 is a sectional view of the essential parts of the compressor stationary blade ring of the gas turbine, showing Embodiment 3 of the present invention.

This is an embodiment in which the outer shroud portions 4 (and spacers 8) in Embodiment 1 are coupled together by a narrow auxiliary band member 7 different from the band member 5 before they are coupled together by the band member 5. Other features are the same as those in Embodiment 1.

According to this embodiment, in addition to the same actions and effects as those in Embodiment 1, there is the advantage that the stationary blades 2 are not separated from each other even when the band member 5 is detached during a dismounting operation for inspection or the like.

The invention thus described, it will be obvious that the same may be varied in many ways. For example, various changes, such as changes in the shapes of the inner and outer shroud portions, the seal holder, and the band member, can be made. In addition, not only the band member, but also various welding methods (laser, arc, electronic beam, etc.) are available as the coupling means. Such variations are not to be regarded as a departure from the spirit and scope of the invention, and all such modifications as would be obvious to one skilled in the art are intended to be included within the scope of the following claims.

What is claimed is:

1. A stationary blade ring of an axial compressor, comprising a plurality of units connected together in a circumferential direction, each unit comprising:

a plurality of stationary blades adjacent to each other in the circumferential direction;

an outer shroud portion dividedly formed per stationary blade, and formed integrally with each stationary blade;

a band member for coupling together the plurality of stationary blades at the outer shroud portions, the band member including a guide groove into which the outer shroud portion is fitted and the band member being directly slidably fitted into a guide groove in a casing of the axial compressor, wherein the band member has a length which corresponds to approximately one quarter of a circumference of the stationary blade ring of the axial compressor;

an inner shroud portion dividedly formed per stationary blade, and formed integrally with each stationary blade;

a first seal holder to hold front portions of the inner shroud portions, the first seal holder having a first guide groove into which the front portions of the inner shroud portions are slidably fitted; and a second seal holder to hold rear portions of the inner shroud portions, the second seal holder having a second guide groove into which the rear portions of the inner shroud portions are slidably fitted, wherein the first seal holder and the second seal holder are arranged in a flowing direction of a working fluid, and the first seal holder and the second seal holder are fastened together by a fastening means, and wherein a pin is inserted into the inner shroud portion and into one of the first seal holder and the second seal holder to bind together the inner shroud portion and the one of the first seal holder and the second seal holder.

2. The stationary blade ring of an axial compressor according to claim 1, wherein the outer shroud portions coupled by the band member are directly slidably fitted into a guide groove portion on a side of a compressor casing.

3. The stationary blade ring of an axial compressor according to claim 1, wherein the first seal holder and the second seal holder have respective lengths corresponding to the plurality of stationary blades adjacent to each other in the circumferential direction.

4. The stationary blade ring of an axial compressor according to claim 1, further comprising an auxiliary band member, different from the band member, which couples together the outer shroud portions for the plurality of stationary blades.

5. A stationary blade ring of an axial compressor, comprising a plurality of units connected together in a circumferential direction, each unit comprising:

a plurality of stationary blades adjacent to each other in the circumferential direction;

an outer shroud portion dividedly formed per stationary blade, and formed integrally with each stationary blade;

connecting means for coupling together the plurality of stationary blades at the outer shroud portions, the connecting means including a guide means into which the outer shroud portion is fitted and the connecting means being directly slidably fitted into a guide groove in a casing of the axial compressor, the connecting means having a length which corresponds to approximately one quarter of a circumference of the stationary blade ring of the axial compressor;

an inner shroud portion dividedly formed per stationary blade, and formed integrally with each stationary blade;

a first seal holder to hold front portions of the inner shroud portions, the first seal holder having a first guide groove into which the front portions of the inner shroud portions are slidably fitted; and a second seal holder to hold rear portions of the inner shroud portions, the second seal holder having a second guide groove into which the rear portions of the inner shroud portions are slidably fitted, wherein the first seal holder and the second seal holder are arranged in a flowing direction of a working fluid, and the first seal holder and the second seal holder are fastened together by a fastening means, and wherein a pin is inserted into the inner shroud portion and into one of the first seal holder and the second seal holder to bind together the inner shroud portion and the one of the first seal holder and the second seal holder.

6. The stationary blade ring of an axial compressor according to claim 5, wherein a spacer is interposed between the inner shroud portions adjacent to each other in the circumferential direction, and a spacer is interposed between the outer shroud portions adjacent to each other in the circumferential direction.

7. The stationary blade ring of an axial compressor according to claim 5, further comprising an auxiliary connecting means, different from the connecting means, which couples together the outer shroud portions for the plurality of stationary blades.

8. A stationary blade ring of an axial compressor, comprising a plurality of units connected together in a circumferential direction, each unit comprising:

a plurality of stationary blades adjacent to each other in the circumferential direction;

an outer shroud portion dividedly formed per stationary blade, and formed integrally with each stationary blade, the outer shroud portion being directly slidably fitted into a guide groove in a casing of the axial compressor;

an inner shroud portion dividedly formed per stationary blade, and formed integrally with each stationary blade;

a first seal holder to hold front portions of the inner shroud portions, the first seal holder having a first guide groove into which the front portions of the inner shroud portions are slidably fitted;

a second seal holder to hold rear portions of the inner shroud portions, the second seal holder having a second guide groove into which the rear portions of the inner shroud portions are slidably fitted;

a dovetail groove formed in an outer peripheral side of the outer shroud portions; and a band member fitted into the dovetail groove of the outer shroud portions to couple the outer shroud portions, wherein the first seal holder and the second seal holder are arranged in a flowing direction of a working fluid, and the first seal holder and the second seal holder are fastened together by a fastening means, and wherein a pin is inserted into the inner shroud portion and into one of the first seal holder and the second seal holder to bind together the inner shroud portion and the one of the first seal holder and the second seal holder.

* * * * *